US011478807B2

(12) United States Patent
Fernando

(10) Patent No.: US 11,478,807 B2
(45) Date of Patent: Oct. 25, 2022

(54) AEROSOL-GENERATING SYSTEM USING THE VENTURI EFFECT TO DELIVER SUBSTRATE TO A HEATING ELEMENT

(71) Applicant: Philip Morris Products S.A., Neuchatel (CH)

(72) Inventor: Keethan Dasnavis Fernando, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 827 days.

(21) Appl. No.: 15/535,470

(22) PCT Filed: Dec. 7, 2015

(86) PCT No.: PCT/EP2015/078799
§ 371 (c)(1),
(2) Date: Jun. 13, 2017

(87) PCT Pub. No.: WO2016/096497
PCT Pub. Date: Jun. 23, 2016

(65) Prior Publication Data

US 2017/0360093 A1 Dec. 21, 2017

(30) Foreign Application Priority Data

Dec. 15, 2014 (EP) ..... 14198023

(51) Int. Cl.
*B05B 7/24* (2006.01)
*A24F 40/485* (2020.01)
(Continued)

(52) U.S. Cl.
CPC ..... *B05B 7/2435* (2013.01); *A24F 40/485* (2020.01); *A24F 40/10* (2020.01); *B01F 25/312* (2022.01)

(58) Field of Classification Search
None
See application file for complete search history.

(56) References Cited

U.S. PATENT DOCUMENTS 4,848,374 A 7/1989 Chard et al.
6,443,146 B1 9/2002 Voges
(Continued)

FOREIGN PATENT DOCUMENTS

CA 2 518 174 A1 11/2004
CN 102655773 A 9/2012
(Continued)

OTHER PUBLICATIONS

Office Action dated Nov. 5, 2019 in Japanese Patent Application No. 2017-531220, 8 pages (with English translation).
(Continued)

*Primary Examiner* — Phu H Nguyen
(74) *Attorney, Agent, or Firm* — Oblon, McClelland, Maier & Neustadt, L.L.P.

(57) ABSTRACT

An aerosol-generating system is provided, including an air inlet and an air outlet; a liquid storage portion having a liquid outlet and being configured to hold a liquid aerosol-forming substrate; an air flow passage from the air inlet to the air outlet past the liquid outlet, wherein the air flow passage is shaped such that there is a pressure drop within the air flow passage at the liquid outlet when air flows from the air inlet to the air outlet through the air flow passage; and a heating element disposed within the air flow passage between the liquid outlet and the air outlet. There is also provide a cartridge for an aerosol-generating system and a method of generating aerosol from a liquid aerosol-forming substrate.

20 Claims, 4 Drawing Sheets

(51) Int. Cl.
*A24F 40/10* (2020.01)
*B01F 25/312* (2022.01)

(56) References Cited

U.S. PATENT DOCUMENTS

| | | | | |
|---|---|---|---|---|
| 6,446,426 | B1 | 9/2002 | Sweeney et al. | |
| 2010/0236546 | A1 | 9/2010 | Yamada et al. | |
| 2011/0094523 | A1* | 4/2011 | Thorens | A61M 11/042 131/194 |
| 2011/0226236 | A1 | 9/2011 | Buchberger | |
| 2011/0309157 | A1 | 12/2011 | Yang et al. | |
| 2011/0315152 | A1 | 12/2011 | Hearn et al. | |
| 2013/0213419 | A1 | 8/2013 | Tucker et al. | |
| 2013/0340775 | A1 | 12/2013 | Juster et al. | |
| 2014/0130496 | A1 | 5/2014 | Honma et al. | |
| 2014/0190496 | A1* | 7/2014 | Wensley | A24F 47/008 131/273 |
| 2014/0202454 | A1 | 7/2014 | Buchberger | |
| 2014/0238423 | A1 | 8/2014 | Tucker et al. | |

FOREIGN PATENT DOCUMENTS

| | | | |
|---|---|---|---|
| CN | 203646499 | U | 6/2014 |
| CN | 203873007 | U | 10/2014 |
| CN | 204180944 | U | 3/2015 |
| DE | 10 2011 111 999 | A1 | 2/2013 |
| EP | 0 295 122 | A2 | 12/1988 |
| EP | 2 319 334 | A1 | 5/2011 |
| JP | 62-262981 | A | 11/1987 |
| JP | 2018-502565 | A | 2/2018 |
| WO | WO 2008/108889 | A1 | 9/2008 |
| WO | WO 2010/045671 | A1 | 4/2010 |
| WO | WO 2012/062600 | A1 | 5/2012 |
| WO | WO 2012/062619 | A1 | 5/2012 |
| WO | WO 2012/164033 | A1 | 12/2012 |
| WO | WO 2013/013808 | A1 | 1/2013 |
| WO | WO 2013/030202 | A1 | 3/2013 |
| WO | WO 2013/083636 | A1 | 6/2013 |
| WO | WO 2013/093469 | A2 | 6/2013 |
| WO | WO 2013/093470 | A2 | 6/2013 |
| WO | WO 2014/012907 | A1 | 1/2014 |
| WO | WO 2015/117700 | A1 | 8/2015 |
| WO | WO 2015/117702 | A1 | 8/2015 |
| WO | WO 2015/117703 | A1 | 8/2015 |
| WO | WO 2015/117704 | A1 | 8/2015 |
| WO | WO 2015/117705 | A2 | 8/2015 |
| WO | WO 2016/092261 | A1 | 6/2016 |

OTHER PUBLICATIONS

Combined Office Action and Search Report dated Jun. 26, 2019 in Chinese Patent Application No. 20158066443.3, 13 pages (with English translation).

International Search Report and Written Opinion dated Feb. 23, 2016 in PCT/EP2015/078799, filed Dec. 7, 2015.

Notice of Allowance dated May 25, 2020 in corresponding Chinese Patent Application No. 201580066443.3, 4 pages.

Extended European Search Report dated Jun. 19, 2015 in Patent Application No. 14198023.5.

International Preliminary Report on Patentability dated Jun. 29, 2017 in PCT/EP2015/078799 filed Dec. 7, 2015.

"Relief Valve", https://en.wikipedia.org/w/index.php?title=Relief_valve&oldid=579609291, Wikipedia, accessed May 2021, 4 pages.

Cyril F. Parry; Excerpt from "Relief Systems Hanbook"; 2004 (ISBN: 9780852954713); 4 pages.

P.S. Soni, Ph.D., et al, "Generation of Aerosols: BARC Nebulizer and Others", 1994, 19 pages.

P.S. Soni, Ph.D., et al, Abstract of "Technical Report, Generation of Aerosols: BARC Nebulizer and Others", Jul. 1, 1994, 3 pages.

Japanese Notification of Reasons for Refusal dated Feb. 18, 2021 in corresponding Japanese Patent Application No. 2020-068867 (with English translation), 8 pages.

* cited by examiner

AEROSOL-GENERATING SYSTEM USING THE VENTURI EFFECT TO DELIVER SUBSTRATE TO A HEATING ELEMENT

The invention relates to aerosol-generating systems in which an aerosol is generated by vapourising a liquid substrate using a heater.

One type of aerosol-generating system is an e-cigarette. E-cigarettes typically operate by heating a liquid aerosol-forming substrate to produce a vapour. The vapour then cools to form an aerosol. Most e-cigarette systems use some form of liquid retaining material, such as a sponge or wicking material, to hold the liquid aerosol-forming substrate and deliver it to a heater. In such systems there are several issues associated with the liquid retaining material. As the liquid retaining material dries out, less liquid is delivered to the heater resulting in a smaller amount of aerosol being delivered. Also, as the liquid retaining material dries out it is more prone to charring or burning. This can lead to undesirable compounds in the generated aerosol. The liquid retaining material also adds cost and complexity to the manufacturing process.

One solution for delivering liquid to a heater that has been proposed and that does not require a liquid retaining material is to use a piezoelectric valve to deliver liquid droplets, either to directly form an aerosol, or to deliver the liquid to a heater. However, piezoelectric valves have significant disadvantages. Piezoelectric valves add even more cost and complexity to the system than liquid retaining materials, and require additional control electronics to be added to the system. Valves consume additional power, which for battery operated systems is a significant consideration. Valves are prone to breaking and clogging. And perhaps most significantly for e-cigarette systems, valves result in a regulated system in which the amount of liquid delivered to generate the aerosol is predetermined, leading to user frustration. A user that inhales more deeply may desire larger amounts of aerosol. Ideally the inhaling or puffing regime of the user should determine the amount of aerosol delivered, as in a conventional cigarette.

It would be desirable to provide an aerosol-generating system that delivers liquid to a heater without the use of liquid retaining material but that does not suffer from the described problems associated with a piezoelectric valve.

In a first aspect there is provided an aerosol-generating system comprising:

- an air inlet and an air outlet;
- a liquid storage portion holding a liquid aerosol-forming substrate, the liquid storage portion having a liquid outlet;
- an air flow passage from the air inlet to the air outlet past the liquid outlet, wherein the air flow passage is shaped so that there is a pressure drop within the air flow passage at the liquid outlet when air flows from the air inlet to the air outlet through the air flow passage; and
- a heating element within the flow path, positioned between the liquid outlet and the air outlet.

The system is advantageously configured so that when air flows from the air inlet to the air outlet through the air flow passage, the pressure at the liquid outlet is lower than the pressure within the liquid storage portion. The pressure within the liquid storage portion may be allowed to equalise with atmospheric pressure. The system may be configured to provide a pressure lower than atmospheric pressure at the liquid outlet when air flows from the air inlet to the air outlet through the air flow passage. To provide a pressure drop at the liquid outlet, the airflow passage may have a restricted cross-section at the liquid outlet relative to the air inlet. The restriction of the airflow passage causes an increase in air speed and a drop in air pressure. This is called the Venturi effect. The reduction of pressure creates suction at the liquid outlet, drawing liquid out of the liquid outlet into the air flow. The liquid drawn into the airflow is then carried in the airflow to the heating element where it is vapourised. The cross-section of the airflow passage at the liquid outlet may also be restricted compared to the air outlet. This arrangement raises the pressure of the air at the outlet as compared to at the liquid outlet.

The system may comprise an aerosol-forming chamber in the air flow passage, between the heating element and the air outlet. The aerosol-forming chamber is a space that allows vapourised aerosol-forming substrate to cool and condense to form an aerosol before exiting the system through the air outlet.

The liquid storage portion provides a sealed enclosure for the aerosol-forming substrate such that fluid cannot enter or exit the enclosure except through the liquid outlet. The sealed enclosure ensures that the liquid aerosol-forming substrate does not leak out of the liquid storage portion unless it is pulled out by a reduced pressure at the liquid outlet as air flows through the airflow passage. As liquid is pulled out of the liquid out it creates a lower pressure inside the liquid storage portion. The higher pressure of the air outside the liquid storage portion retains the remaining liquid in the liquid storage portion.

The size of the pressure drop in the airflow passage depends not only on the geometry of the airflow passage but also on the airflow speed through the airflow passage. A faster airflow results in a larger pressure drop. A larger pressure drop results in a greater volume of liquid aerosol-forming substrate being pulled out into the airflow. So the faster the airflow speed through the system, the greater the total particulate mass (TPM) of the generated aerosol. In a puff actuated system, this means that a user that puffs more deeply will receive a greater quantity of aerosol that a user that puffs less deeply.

Advantageously the liquid storage portion contains a pocket of air at lower pressure than atmospheric pressure. Only when the pressure at the liquid outlet is lower than the pressure of the air within the liquid storage portion will liquid be pulled out into the airflow passage. The liquid storage portion may be configured so that when air is not flowing through the airflow passage from the air inlet to the air outlet air can enter the liquid storage portion through the liquid outlet to equalise the air pressure inside and outside of the liquid storage portion. This ensures that as the amount of liquid aerosol-forming substrate in the liquid storage portion reduces, it does not get progressively harder to draw liquid out into the airflow if there are breaks between airflow periods, for example between user inhalations.

Alternatively, or in addition, the liquid storage portion may comprise a low pressure release valve that allows air to enter the liquid storage portion when in an open position but not when in a closed position. The valve may be configured to move to an open position when the pressure difference across the valve exceeds a pressure threshold. The system may be configured such that the valve is controlled to be in a closed position when a predetermined flow rate of air flows through the air flow passage, for example when a user is puffing on the air outlet. The system may be configured so that the valve is in an open position to equalise the air pressure inside and outside of the liquid storage portion between user puffs.

The liquid storage portion may comprise an annular housing, and the air flow passage may extend through the annular housing. This allows for a symmetrical and compact system to be provided.

The cross-sectional area of the airflow passage and the amount by which it is reduced at the liquid outlet can be chosen to suit the particular requirements of the system. In a preferred embodiment, the cross sectional area of the air inlet is between 1 $mm^2$ and 3.5 $mm^2$ and the cross-sectional area of the airflow passage at the liquid outlet is between 0.1 $mm^2$ and 0.9 $mm^2$. The airflow passage may have any desired cross-sectional shape, such as circular or oval. The airflow passage may be shaped to promote laminar airflow. Alternatively, or in addition, the airflow passage may include impact surfaces to aid diffusion of the liquid or aerosol. The airflow passage may be configured to provide a pressure drop of at least 250 Pa for a typical user puff.

The liquid outlet may be annular and may surround the airflow passage. Alternatively, the airflow passage may be annular and may surround the liquid outlet. The size of the liquid outlet has a direct influence on the amount of liquid delivered into the airflow passage.

The heating element is positioned in the airflow passage. The heating element may span the air flow channel and be fluid permeable so that the airflow must pass through the heating element to reach the air outlet. The heating element may comprise a mesh, array or fabric of heater filaments.

Alternatively the heating element or a plurality of heating elements may surround the airflow passage or extend partially across the airflow passage.

The heating element may operate by resistive heating, wherein an electric current is passed through the heating element to generate heat. Alternatively, the heating element may be inductively heated. Alternatively the heating element may be heated by thermal conduction from another heat source such as a chemical heat source. The heating element may be part of a heater assembly comprising, for example, electrical contact pads and an electrically insulating substrate.

The material or materials chosen for the heating element may depend on its mode of operation. In a preferred embodiment the heating element is configured to be resistively heated and comprises a mesh, array or fabric of electrically conductive filaments. The electrically conductive filaments may define interstices between the filaments and the interstices may have a width of between 10 μm and 100 μm.

The electrically conductive filaments may form a mesh of size between 160 and 600 Mesh US (+/−10%) (i.e. between 160 and 600 filaments per inch (+/−10%)). The width of the interstices is preferably between 75 μm and 25 μm. The percentage of open area of the mesh, which is the ratio of the area of the interstices to the total area of the mesh is preferably between 25 and 56%. The mesh may be formed using different types of weave or lattice structures. Alternatively, the electrically conductive filaments consist of an array of filaments arranged parallel to one another.

The electrically conductive filaments may have a diameter of between 10 μm and 100 μm, preferably between 8 μm and 50 μm, and more preferably between 8 μm and 39 μm. The filaments may have a round cross section or may have a flattened cross-section.

The area of the mesh, array or fabric of electrically conductive filaments may be small, preferably less than or equal to 25 $mm^2$, allowing it to be incorporated in to a handheld system. The mesh, array or fabric of electrically conductive filaments may, for example, be rectangular and have dimensions of 5 mm by 2 mm. Preferably, the mesh or array of electrically conductive filaments covers an area of between 10% and 50% of the area of the heater assembly. More preferably, the mesh or array of electrically conductive filaments covers an area of between 15 and 25% of the area of the heater assembly.

The filaments may be formed by etching a sheet material, such as a foil. This may be particularly advantageous when the heater assembly comprises an array of parallel filaments. If the heating element comprises a mesh or fabric of filaments, the filaments may be individually formed and knitted together.

The filaments of the heating element may be formed from any material with suitable electrical properties. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation. The filaments may be coated with one or more insulators. Preferred materials for the electrically conductive filaments are 304, 316, 304L, 316L stainless steel, and graphite.

The heating assembly may comprise an electrically insulating substrate on which the filaments are supported. The electrically insulating substrate may comprise any suitable material, and is preferably a material that is able to tolerate high temperatures (in excess of 300° C.) and rapid temperature changes. An example of a suitable material is a polyimide film, such as Kapton®. The electrically insulating substrate may have an aperture formed in it, with the electrically conductive filaments extending across the aperture. The heater assembly may comprise electrical contacts connected to the electrically conductive filaments.

The electrical resistance of the mesh, array or fabric of electrically conductive filaments of the heater element is preferably between 0.3 and 4 Ohms. More preferably, the electrical resistance of the mesh, array or fabric of electrically conductive filaments is between 0.5 and 3 Ohms, and more preferably about 1 Ohm. The electrical resistance of the mesh, array or fabric of electrically conductive filaments is preferably at least an order of magnitude, and more preferably at least two orders of magnitude, greater than the electrical resistance of the contact portions. This ensures that the heat generated by passing current through the heating element is localised to the mesh or array of electrically conductive filaments. It is advantageous to have a low overall resistance for the heater element if the system is powered by a battery. A low resistance, high current system allows for the delivery of high power to the heater element. This allows the heating element to heat the electrically conductive filaments to a desired temperature quickly.

The first and second electrically conductive contact portions may be fixed directly to the electrically conductive filaments. The contact portions may be positioned between the electrically conductive filaments and the electrically insulating substrate. For example, the contact portions may be formed from a copper foil that is plated onto the insulating substrate. The contact portions may also bond more readily with the filaments than the insulating substrate would.

Alternatively, the first and second electrically conductive contact portions may be integral with the electrically conductive filaments. For example, the heater element may be formed by etching a conductive sheet to provide a plurality of filaments between two contact portions.

The system may include a filter pad, such as a Cambridge filter pad, downstream of the heating element. The filter pad may be in contact with the heater element. This may help prevent leakage of liquid through the air outlet and may remove any undesirable particulate matter from the aerosol.

The heating element may comprise at least one filament made from a first material and at least one filament made from a second material different from the first material. This may be beneficial for electrical or mechanical reasons. For example, one or more of the filaments may be formed from a material having a resistance that varies significantly with temperature, such as an iron aluminium alloy. This allows a measure of resistance of the filaments to be used to determine temperature or changes in temperature. This can be used in a puff detection system and for controlling heating element temperature to keep it within a desired temperature range. Sudden changes in temperature may also be used as a means to detect changes in air flow past the heating element resulting from a user puffing on the system.

The system may comprise a disposable cartridge portion and a device portion, wherein the cartridge comprises the liquid storage portion. Once the liquid aerosol-forming substrate in the liquid storage portion is exhausted the cartridge is thrown away and replaced by a new cartridge.

The cartridge may comprise the heating element. Alternatively the heating element may be provided as part of the device.

The system may comprise a mouthpiece portion configured to be received in a user's mouth. The air outlet may be in the mouthpiece portion. The mouthpiece portion may be part of a cartridge portion or of a device portion, or may comprise a separate portion. A disposable mouthpiece may be provided as part of the mouthpiece portion. The disposable mouthpiece may be pliable and may mimic the feel of a conventional cigarette filter.

The system may further comprise electric circuitry connected to the heating element assembly and to an electrical power source, the electric circuitry configured to monitor the electrical resistance of the heating element or of one or more filaments of the heating element, and to control the supply of power to the heating element dependent on the electrical resistance of the heating element or the one or more filaments.

The electric circuitry may comprise a microprocessor, which may be a programmable microprocessor. The electric circuitry may comprise further electronic components. The electric circuitry may be configured to regulate a supply of power to the heating element. Power may be supplied to the heating element continuously following activation of the system or may be supplied intermittently, such as on a puff-by-puff basis. The power may be supplied to the heating element in the form of pulses of electrical current.

The system advantageously comprises a power supply, typically a battery, within the main body of the housing. As an alternative, the power supply may be another form of charge storage device such as a capacitor. The power supply may require recharging and may have a capacity that allows for the storage of enough energy for one or more smoking experiences; for example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heating element.

Preferably, the aerosol generating system comprises a housing. Preferably, the housing is elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

Preferably, the aerosol-generating system is portable. The aerosol-generating system may have a size comparable to a conventional cigar or cigarette. The smoking system may have a total length between approximately 30 mm and approximately 150 mm. The smoking system may have an external diameter between approximately 5 mm and approximately 30 mm.

The aerosol-forming substrate is a substrate capable of releasing volatile compounds that can form an aerosol. The volatile compounds may be released by heating the aerosol-forming substrate. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material. The aerosol-forming substrate may comprise homogenised tobacco material. The aerosol-forming substrate may comprise at least one aerosol-former. An aerosol former is any suitable known compound or mixture of compounds that, in use, facilitates formation of a dense and stable aerosol and that is substantially resistant to thermal degradation at the operating temperature of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine such as glycerine or propylene glycol. The aerosol-forming substrate may comprise other additives and ingredients, such as flavourants. In one example the aerosol-forming substrate comprises a mixture of glycerine, propylene glycol (PG), water and flavourings, and nicotine. In a preferred embodiment, the aerosol-forming substrate comprises approximately 40% by volume PG, 40% by volume glycerine, 18% by volume water and 2% by volume nicotine. This substrate has a viscosity of 20 Pa·s.

In a second aspect, there is provided a cartridge for use in an aerosol-generating system, the cartridge comprising:

an air inlet and an air outlet;

a liquid storage portion holding a liquid aerosol-forming substrate, the liquid storage portion having a liquid outlet; and an air flow passage from the air inlet to the air outlet past the liquid outlet, wherein the air flow passage is shaped so that there is a pressure drop within the air flow passage at the liquid outlet when air flows from the air inlet to the air outlet through the air flow passage.

The cartridge may comprise a heater element in the air flow passage between the liquid outlet and the air outlet. The heater element may be a heater element as described with reference to the first aspect of the invention.

The cartridge may comprise electrical contacts configured to contact corresponding features on a device to which the cartridge engages to allow for a supply of electrical current to the heating element from a power source in the device.

In a third aspect of the invention, there is provided a method of generating aerosol from a liquid aerosol-forming substrate comprising:

providing a liquid storage portion having a liquid outlet;

providing an air flow passage past the liquid outlet;

drawing liquid aerosol-forming substrate out of the liquid outlet into an air flow in the air flow passage by creating a pressure drop in the air flow at the liquid outlet and conveying the liquid in the air flow to a heater element in the air flow passage, the heater element vapourising the liquid to provide a vapour;

cooling the vapour to provide an aerosol.

Features described in relation to one aspect may equally be applied to other aspects of the invention. In particular features of the liquid storage portion, airflow passage, heating element, and aerosol-forming substrate described in relation to the first aspect may equally be applied to the second aspect and the third aspect.

Preferred embodiments of the invention will now be described, by way of example only, with reference to the accompanying drawings, in which.

Figure 1:
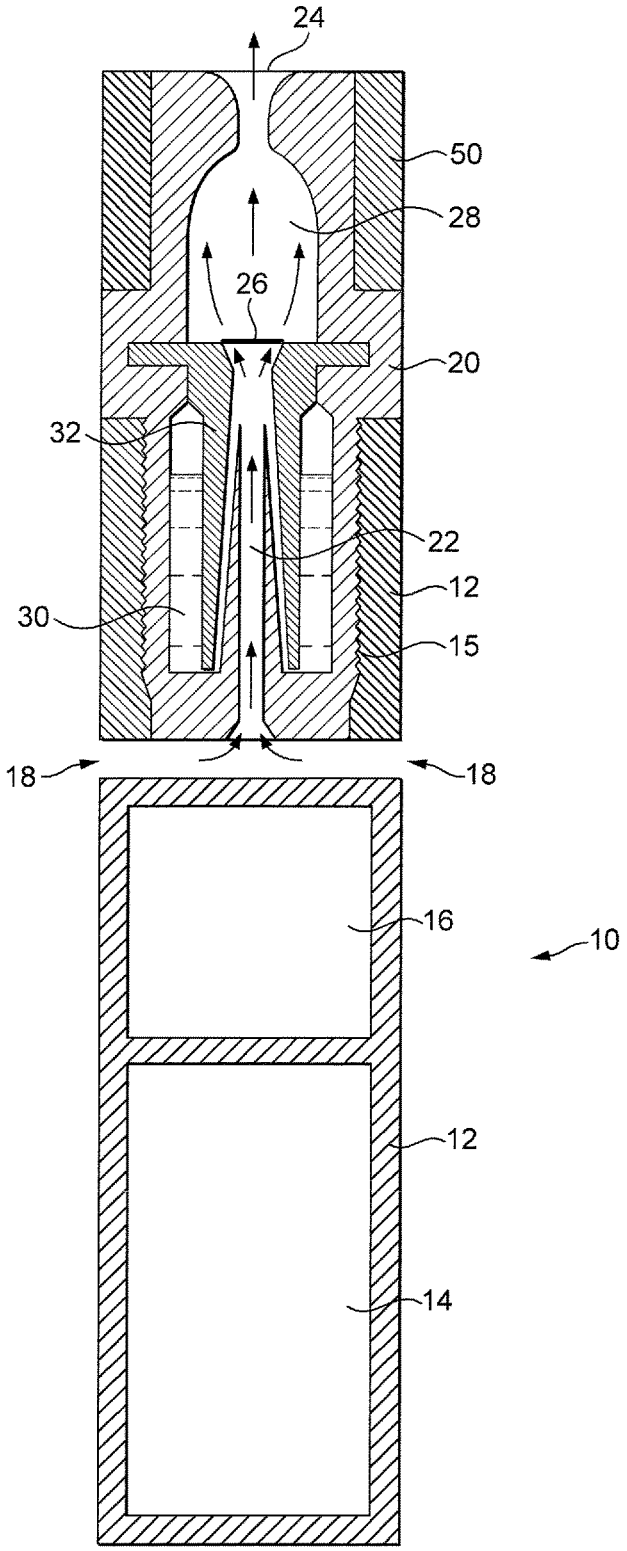
FIG. 1 is a schematic cross-section of a system in accordance with a first embodiment.

FIG. 1 is a schematic cross-section of an aerosol-generating system in accordance with an embodiment of the invention. The system shown in FIG. 1 is an electrically operated, handheld smoking system, often referred to as an e-cigarette. The system comprises a device 10 and a cartridge 20 which, together with a disposable mouthpiece 50, form the smoking system.

The device comprises a housing 12 containing a battery 14, such as a lithium iron phosphate battery, control electronics 16, a cavity 15 for receiving a portion of the cartridge 20 and air inlets 18. The device has a circular cross-section and comprises a plurality of air inlets 18 disposed around the circumference of the device housing 12. The cavity 15 has a screw thread (not shown) for engaging a corresponding screw thread on the cartridge 20. However it should be clear that many other types of connection between the cartridge and the device could be used. The battery 14 and control electronics 16 provide electrical power to the cartridge through electrical connections (not shown), as will be described. Again, any type of connection can be used to provide the electrical contact between the cartridge and device, such as a snap-fit, inference fit, or bayonet type connection.

Figure 2:
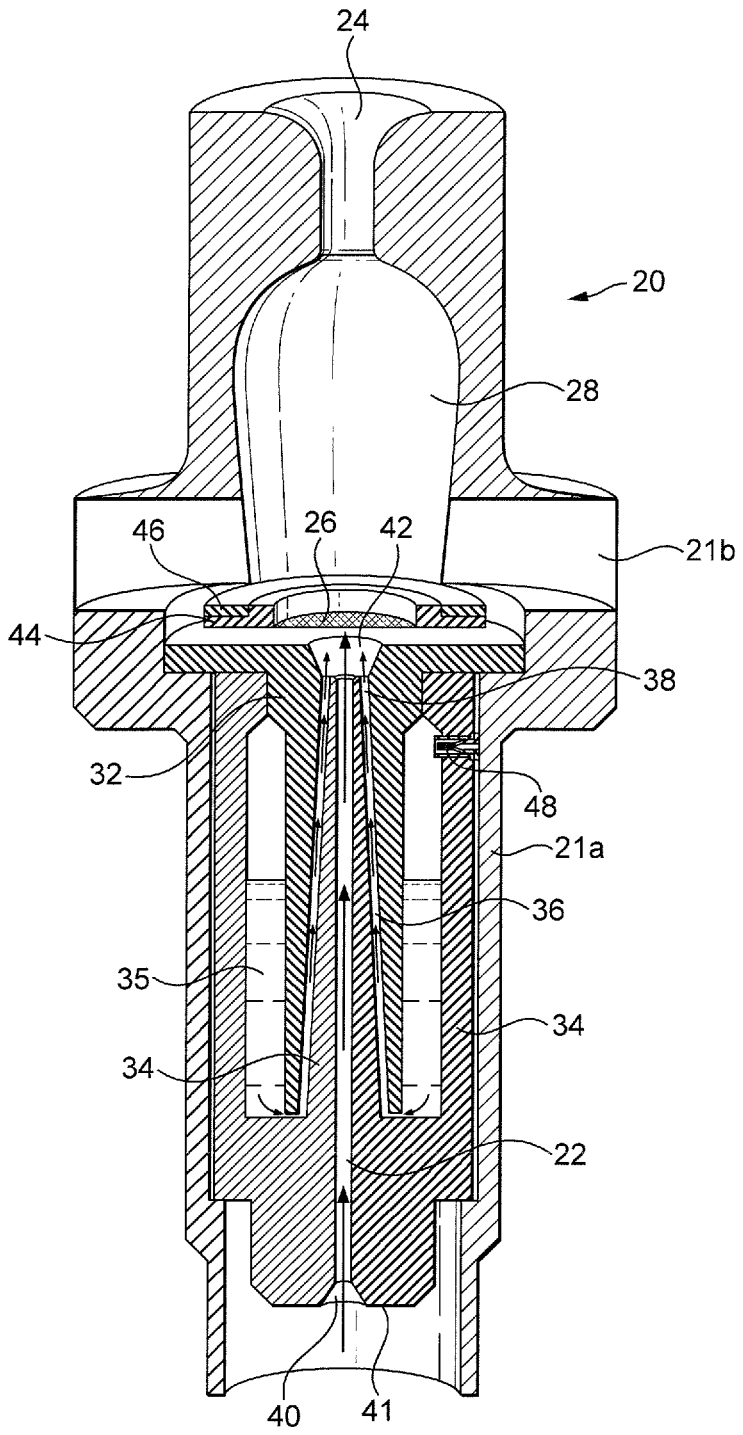
FIG. 2 is a cross-section of the cartridge of FIG. 1.
Figure 3:
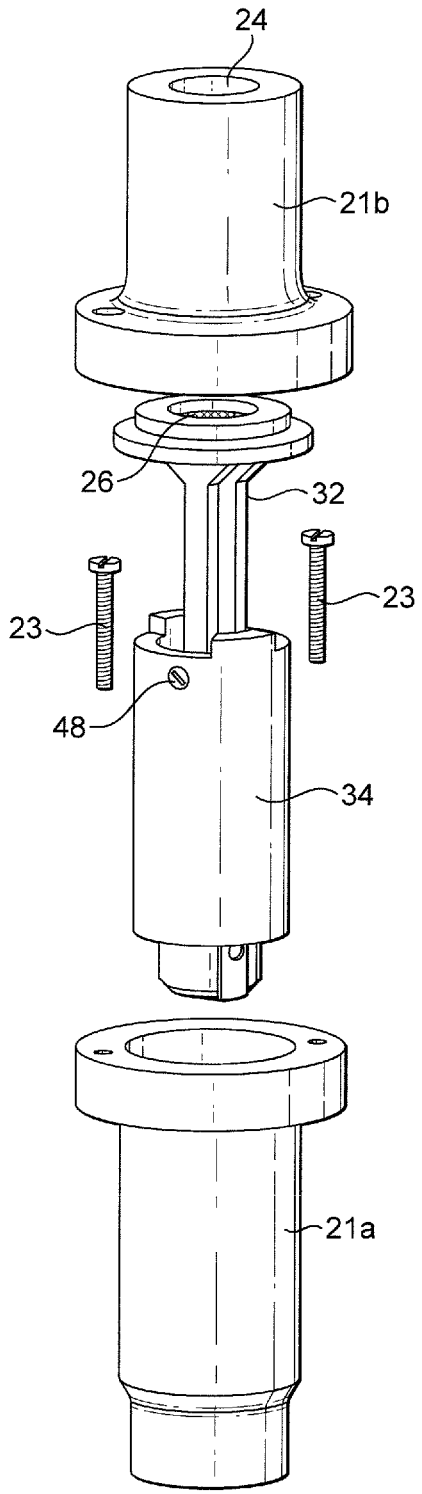
FIG. 3 is an exploded view of the cartridge of FIG. 2.
Figure 4:
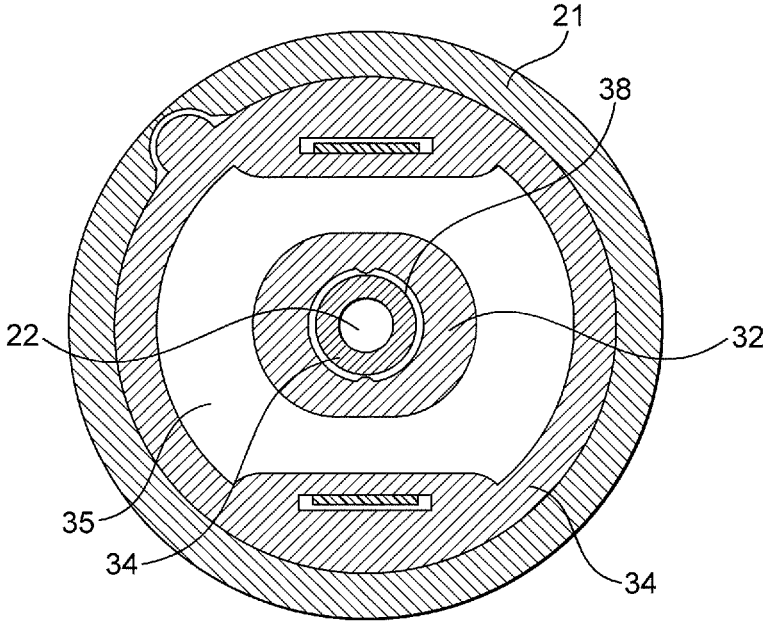
FIG. 4 is a lateral cross-section of the cartridge of FIG. 2.

The cartridge 20 is shown engaged with the device 10 in FIG. 1 but is shown separately and in more detail in FIGS. 2, 3 and 4.

The cartridge 20 has an outer cartridge housing 21. A liquid storage portion 30 having a liquid storage housing 34 is provided inside the outer cartridge housing 21. The liquid storage portion housing is annular and an airflow passage 22 is formed through its centre. The airflow passage has an inlet end which has a narrowing portion 40 so that the airflow passage within the liquid storage housing is constricted relative to the airflow through the inlet end. The orifice in the inlet plate 41 has a radius of 1 mm whereas the airflow channel within the liquid storage housing has a radius of 0.375 mm.

A reservoir of liquid aerosol-forming substrate is held between inner and outer walls of the liquid storage housing 34. A spigot 32 extends into the reservoir to define a constricted liquid flow path 36 for liquid from the reservoir to a liquid outlet 38 in the air flow passage. The liquid outlet 38 is substantially annular, as best seen in FIG. 4. The inner diameter of the liquid outlet at the base of the liquid storage portion is around 1.5 mm, the outer diameter of the liquid outlet is around 1.75 mm. Small slots or openings (not shown) are provided in the base of the reservoir to properly locate the spigot and ensure that the spigot is centred relative to the reservoir.

The air flow passage immediately downstream of the liquid outlet is defined by the spigot, and widens in a divergent portion 42.

A heating element 26 is supported on the spigot 32 downstream of the liquid outlet. The heating element is a mesh formed from 304L stainless steel, with a mesh size of about 400 Mesh US (about 400 filaments per inch). The filaments of the mesh have a diameter of around 16 μm. The mesh is connected to electrical contacts 46 that are formed from copper. The electrical contacts 32 are provided on a polyimide substrate 44. The filaments forming the mesh define interstices between the filaments. The interstices in this example have a width of around 37 μm, although larger or smaller interstices may be used. The open area of the mesh, i.e. the ratio of the area of interstices to the total area of the mesh is advantageously between 25 and 56%. The total resistance of the heater assembly is around 1 Ohm. The mesh provides the vast majority of this resistance so that the majority of the heat is produced by the mesh. In this example the mesh has an electrical resistance more than 100 times higher than the electrical contacts 46.

An aerosol-forming chamber 28 is provided downstream of the heater. The aerosol-forming chamber 28 is a region in which vapour from the heater can cool and condense to form aerosol before exiting the air outlet 24 into a user's mouth.

As most clearly seen in FIG. 3, the outer cartridge housing is formed in two parts to permit assembly. Lower cartridge housing 21*a* supports the liquid storage portion, spigot and heater assembly. Upper cartridge housing 21*b* defines a mouthpiece portion of the cartridge and holds the aerosol-forming chamber and the air outlet 24. The disposable mouthpiece 50 is positioned around the upper cartridge housing, as shown in FIG. 1. The upper and lower cartridge housings are secured to each another by a pair of threaded bolts 23 and corresponding nuts (not shown).

The cartridge housing and the device housing may comprise any suitable material or combination of materials. In this example, polypropylene, polyetheretherketone (PEEK) is used.

The removable mouthpiece 50 may mimic the filter of a conventional cigarette in look and feel. For example, the removable mouthpiece 50 may be formed from cellulose acetate, rubber, or plastic, such as polyethylene or polypropylene or a mixture of both, and may be covered with a paper layer.

In operation, when a user puffs on the mouthpiece portion, air is drawn through the airflow passage from the air inlets 18 to the air outlet 24. The air is drawn through the airflow passage past the liquid outlet, through the heater to the aerosol-forming chamber. The pressure of the airflow at the liquid outlet is lower than atmospheric pressure and crucially lower than the pressure of the air 35 within the liquid storage portion. This pressure difference causes liquid aerosol-forming substrate to be drawn out of the liquid outlet into the airflow passage.

The approximate volume of liquid drawn into the airflow from the liquid outlet can be calculated using Poiseuille's equation. For the sake of calculation, consider a 1 second puff of 40 ml.

The velocity of the air travelling through the unconstructed section and the constricted section of the airflow channel is calculated as follows:

$$\text{Velocity}_{(2)}:(40\ \text{mm}^3*10^3)/[3.14*(1\ \text{mm})^2]=12.7*10^3\ \text{mm/s}$$

$$\text{Velocity}_{(1)}:(40\ \text{mm}^3*10^3)/[3.14*(0.375\ \text{mm})^2]=90*10^3\ \text{mm/s}$$

From these velocities a pressure differential can be calculated:

$$P_2-P_1=\rho/2(v_2^2-v_1^2)=\tfrac{1}{2}(90^2-12.7^2)=\text{approx. 4000 kg mm}^{-1}\ \text{s}^{-2}$$

In this example, the liquid droplets originate from an annular tube with width 0.25 mm, whose "area equivalence" for the cartridge we can be estimated by multiplying the ring's circumference ($2*\pi*r=2*\pi*1$ mm) by its width of 0.25 mm:

$$\text{Approximate Area(of liquid delivery)}=2\pi r*\text{width}=2*3.14*1*0.25\ \text{mm}=1.57\ \text{mm}^2$$

Thus the approximate "radial equivalence" for the sake of estimating liquid delivery is:

$$(1.57/\pi)^{0.5}=0.75\ \text{mm}$$

The liquid viscosity for the liquid aerosol-forming substrate can be estimated from the liquid's composition, in this example:

PG (52%), Glycerin (20%), Water (15%) and nicotine (5%)

$$\text{Approximately}:0.6*52+0.2*1.4+0.15*1.0022+0.05*1.004=32\ \text{Pa s}$$

Finally, the liquid delivery can be calculated using the Pressure Differential (ΔP), the radial equivalence (r), the liquid viscosity (μ) and the length of the liquid flow path (L):

$$Q=(\Delta P*\pi r^4)/(8\ \mu L)=[4000*\pi*(0.75*10^{-3})^4]/(8*32*14)=\text{between 0.8 mm}^3\ \text{s}^{-1}\ \text{and 1 mm}^3\ \text{s}^{-1}.$$

It can be seen that key parameters for determining the volume of droplet delivery are the surface area of the liquid outlet in the cartridge the pressure drop at the liquid outlet and the length of the liquid flow path. The liquid flow path is to some extent limited by the overall length of the cartridge and for a handheld system would desirably be between 10 mm and 30 mm. It can also be seen from this equation that the viscosity of the liquid aerosol-forming substrate is also a significant factor, such that if the liquid viscosity increases then to achieve the same liquid delivery the dimensions of the liquid outlet and/or liquid path would need to be altered.

The liquid aerosol-forming substrate in the airflow is conveyed to the mesh heating element. The mesh heating element, which may be activated in response to a sensed user puff, vapourises the liquid aerosol-forming substrate as it contacts or passes through the heating element. The vapourised substrate and heated air then passes into the aerosol-forming chamber where it cools to form an aerosol. The aerosol is then drawn out of the air outlet 24 and into the user's mouth.

As a user puffs on the system and liquid is drawn out of the liquid storage portion, the pressure inside the liquid storage portion drops. In order to provide consistent liquid delivery from puff to puff, the pressure inside the liquid storage portion is advantageously allowed to return to its initial pressure, typically atmospheric pressure, between puffs. The liquid outlet may be large enough to allow air bubbles to enter the liquid storage portion through the liquid outlet between puffs. Alternatively, a pressure relief valve 48 may be included in the liquid storage portion that opens when the pressure difference between the inside of the liquid storage portion and outside the liquid storage portion exceeds a threshold pressure difference. This is illustrated in FIGS. 2 and 3. The pressure relief valve 48 may be controlled to remain closed during each user puff.

A system as described has several advantages over prior systems. It is a mechanically robust system that does not require winding a heater around a flexible wicking material. It eliminates the potential for burning or charring of a capillary material in contact with a heating element. It eliminates the need for a liquid retaining material and so reduces manufacturing costs and a manufacturing step. It also eliminates a potential aerosol fading issue found with capillary based systems, whereas the liquid is depleted the amount of liquid delivered to the heating element is reduced, similar to the fading of a felt-tipped pen.

When compared to piezoelectric based delivery systems, it is energy efficient, as it uses the depressurization occurring during puffing to deliver the liquid droplets to the heater. It also allows the user's puffing behaviour to control the amount of liquid delivered rather than the amount of liquid being metered by a piezoelectric valve.

The exemplary embodiments described above illustrate but are not limiting. In view of the above discussed exemplary embodiments, other embodiments consistent with the above exemplary embodiments will now be apparent to one of ordinary skill in the art. For example, the embodiment described is an electrically operated smoking system, but the invention may be applied to any type of aerosol-generating system, and different liquid and airflow geometries may be used.

The invention claimed is:

1. An aerosol-generating system, comprising:

an air inlet and an air outlet;

a liquid storage portion having a liquid outlet and being configured to hold a liquid aerosol-forming substrate;

an air flow passage from the air inlet to the air outlet past the liquid outlet, wherein the air flow passage is shaped such that there is a pressure drop within the air flow passage at the liquid outlet when air flows from the air inlet to the air outlet through the air flow passage, the pressure drop creating suction at the liquid outlet that draws liquid out of the liquid outlet and into the air flow passage; and a heating element disposed within the air flow passage between the liquid outlet and the air outlet.

2. The aerosol-generating system according to claim 1, wherein the airflow passage has a restricted cross-section at the liquid outlet relative to the air inlet.

3. The aerosol-generating system according to claim 1, wherein the liquid storage portion provides a sealed enclosure for the aerosol-forming substrate such that a fluid cannot enter or exit the sealed enclosure except through the liquid outlet.

4. The aerosol-generating system according to claim 1, wherein the liquid storage portion comprises an air inlet valve configured to allow air to enter the liquid storage portion when in an open position but not when in a closed position.

5. The aerosol-generating system according to claim 4, wherein the system is configured such that the valve is controlled to be in a closed position when a predetermined flow rate of air flows through the air flow passage.

6. The aerosol-generating system according to claim 1,
wherein the liquid storage portion comprises an annular housing, and
wherein the air flow passage extends through the annular housing.

7. The aerosol-generating system according to claim 1, wherein the liquid outlet is annular.

8. The aerosol-generating system according to claim 1, wherein the heating element spans the air flow passage and is fluid permeable.

9. The aerosol generating system according to claim 8, wherein the heating element comprises a mesh of heater filaments, or an array of heater filaments, or a fabric of heater filaments, or a combination thereof.

10. The aerosol-generating system according to claim 1, further comprising an electrical power supply connected to the heating element, wherein the heating element is configured to be resistively heated.

11. The aerosol-generating system according to claim 1, further comprising a disposable cartridge and a device, wherein the disposable cartridge comprises the liquid storage portion.

12. The aerosol-generating system according to claim 11, wherein the disposable cartridge further comprises the heating element.

13. An aerosol-generating system, comprising:
an air inlet and an air outlet;
a liquid storage portion having a liquid outlet and being configured to hold a liquid aerosol-forming substrate;
an air flow passage from the air inlet to the air outlet past the liquid outlet, wherein the air flow passage is shaped such that there is a pressure drop within the air flow passage at the liquid outlet when air flows from the air inlet to the air outlet through the air flow passage, the pressure drop creating suction at the liquid outlet that draws liquid out of the liquid outlet and into the air flow passage without aid of a liquid-retaining material extending beyond the liquid outlet; and
a heating element disposed within the air flow passage between the liquid outlet and the air outlet.

14. The aerosol-generating system according to claim 13, wherein the airflow passage has a restricted cross-section at the liquid outlet relative to the air inlet.

15. The aerosol-generating system according to claim 13, wherein the liquid storage portion provides a sealed enclosure for the aerosol-forming substrate such that a fluid cannot enter or exit the sealed enclosure except through the liquid outlet.

16. The aerosol-generating system according to claim 13,
wherein the liquid storage portion comprises an air inlet valve configured to allow air to enter the liquid storage portion when in an open position but not when in a closed position, and
wherein the system is configured such that the valve is controlled to be in a closed position when a predetermined flow rate of air flows through the air flow passage.

17. The aerosol-generating system according to claim 13,
wherein the liquid storage portion comprises an annular housing,
wherein the air flow passage extends through the annular housing, and
wherein the liquid outlet is annular.

18. The aerosol-generating system according to claim 13,
wherein the heating element spans the air flow passage and is fluid permeable, and
wherein the heating element comprises a mesh of heater filaments, or an array of heater filaments, or a fabric of heater filaments, or a combination thereof.

19. The aerosol-generating system according to claim 13, further comprising an electrical power supply connected to the heating element, wherein the heating element is configured to be resistively heated.

20. The aerosol-generating system according to claim 13, further comprising a disposable cartridge and a device, wherein the disposable cartridge comprises the liquid storage portion and the heating element.

* * * * *